US006297608B1

(12) United States Patent
Lin

(10) Patent No.: US 6,297,608 B1
(45) Date of Patent: Oct. 2, 2001

(54) DRIVE CIRCUIT FOR A SPEED AUTOMATICALLY ADJUSTED FAN

(75) Inventor: Yu Liang Lin, Kaohsiung (TW)

(73) Assignee: Asia Vitel Components Co., LTD (TW)

( * ) Notice: Subject to any disclaimer, the term of this patent is extended or adjusted under 35 U.S.C. 154(b) by 0 days.

(21) Appl. No.: 09/515,403

(22) Filed: Feb. 29, 2000

(30) Foreign Application Priority Data

Dec. 6, 1999 (TW) ..... 088220777

(51) Int. Cl.[7] ..... H02P 1/04
(52) U.S. Cl. ..... 318/471; 318/439
(58) Field of Search ..... 318/254, 439, 318/471, 473

(56) References Cited

U.S. PATENT DOCUMENTS

| | | | | |
|---|---|---|---|---|
| 3,560,824 | * | 2/1971 | Burke | 318/227 |
| 3,801,888 | * | 4/1974 | Faulkner | 318/471 |
| 4,722,669 | * | 2/1988 | Kundert | 417/32 |
| 4,748,388 | * | 5/1988 | Muller | 318/254 |
| 4,804,902 | * | 2/1989 | Maier | 318/798 |
| 4,806,832 | * | 2/1989 | Muller | 318/334 |
| 5,093,891 | * | 3/1992 | Komiyama et al. | 388/813 |
| 5,197,858 | * | 3/1993 | Cheng | 417/14 |
| 5,363,024 | * | 11/1994 | Hiratsuka et al. | 318/254 |
| 5,457,766 | * | 10/1995 | Ko | 388/831 |
| 5,563,480 | * | 10/1996 | Okada | 318/254 |
| 5,831,405 | * | 11/1998 | Massie | 318/471 |

* cited by examiner

*Primary Examiner*—Robert E. Nappi
*Assistant Examiner*—Rina I. Duda
(74) *Attorney, Agent, or Firm*—Connolly Bove Lodge & Hutz LLP

(57) ABSTRACT

A drive circuit for a speed automatically adjusted fan comprises an actuating circuit, a temperature control circuit and a current control circuit. The actuating circuit has a Hall IC to control two transistors in a state of connecting and in a state of disconnecting sequentially so as to alternately magnetize two coils connecting to the two transistors respectively and then to rotate the fan. The temperature control circuit has a heat sensitive resistance to sense the ambient temperature and varies resistance value thereof accordingly such that the magnitude of the current passing through. The current flowing through the current control circuit is fed back to the actuating circuit so that the speed of the fan can be changed with respect to the magnitude of the current to meet the purpose of speed automatically adjusted for the fan.

1 Claim, 2 Drawing Sheets

DRIVE CIRCUIT FOR A SPEED AUTOMATICALLY ADJUSTED FAN

BACKGROUND OF THE INVENTION

1. Field of the Invention

The present invention relates to a drive circuit for a speed automatically adjusted fan, particularly to a drive circuit, with which the speed of the fan can be properly adjusted depending on the ambient temperature.

2. Description of Related Art

A prior art of drive circuit for a fan, as shown in FIG. 1, is illustrated. The output terminal of a Hall IC is connected to the base pole of a transistor (Q1'). The collector of the transistor (Q1') is connected to a coil (V1') of the DC fan and then to the base pole of another transistor (Q2') through a resistor (R2'). The collector of the transistor (Q2') is connected to another coil (V2') of the fan. Both the emitters in the two transistors (Q1', Q2') are connected to the negative pole of the power supply. The two transistors (Q1', Q2') control the coils (V1', V2') of the fan, while the Hall IC sequentially controls the connection and the disconnection between the two transistors (Q1', Q2') to alternately magnetize of the coils (V1', V2') so as to rotate the fan. However, the circuit passing through the coils (V1', V2') is not possible to be changed so as to adjust the speed of the fan with respect to the ambient temperature once the coils and the power supply are fixedly arranged. It is a trend that the speed of the fan can be a variable with respect to the change of the ambient temperature. In addition to running under a maximum load condition for dissipating the heat, the fan is possible to generate noise either under a minimum load condition.

Therefore, based on regulations of the energy and the noise for the environmental protection, the problems involved in the conventional drive circuit for a fan have to be solved advantageously. In view of the drawbacks of the conventional drive circuit, the inventor has dedicated in research and design and has endeavored tests. Finally, a drive circuit for a speed automatically adjusted fan in accordance with the present invention is developed.

SUMMARY OF THE INVENTION

The drive circuit for a speed automatically adjusted fan according to the present invention resides in that the drive circuit is comprised of an actuating circuit, a temperature control circuit and a current control circuit. The actuating circuit has a Hall IC to control two transistors in a state of connecting and in a state of disconnecting sequentially to alternately magnetize two coils respectively so as to rotate the fan. A heat sensitive resistor in the temperature control circuit senses the temperature and changes its resistance with respect to a variation of the temperature such that the current passing through has the magnitude thereof be controlled. Thus, the current is fed back into the actuating circuit through the current control circuit and speed of the fan can be changed with respect to the magnitude of the current.

An objective of the present invention is to provide a drive circuit for a speed automatically adjusted fan with which the speed of the fan can be controlled automatically in accordance with the ambient temperature around the fan.

BRIEF DESCRIPTION OF DRAWINGS

The present invention can be more fully understood by reference to the following description and accompanying drawings, in which.

DETAILED DESCRIPTION OF PREFERRED EMBODIMENTS

Figure 1:
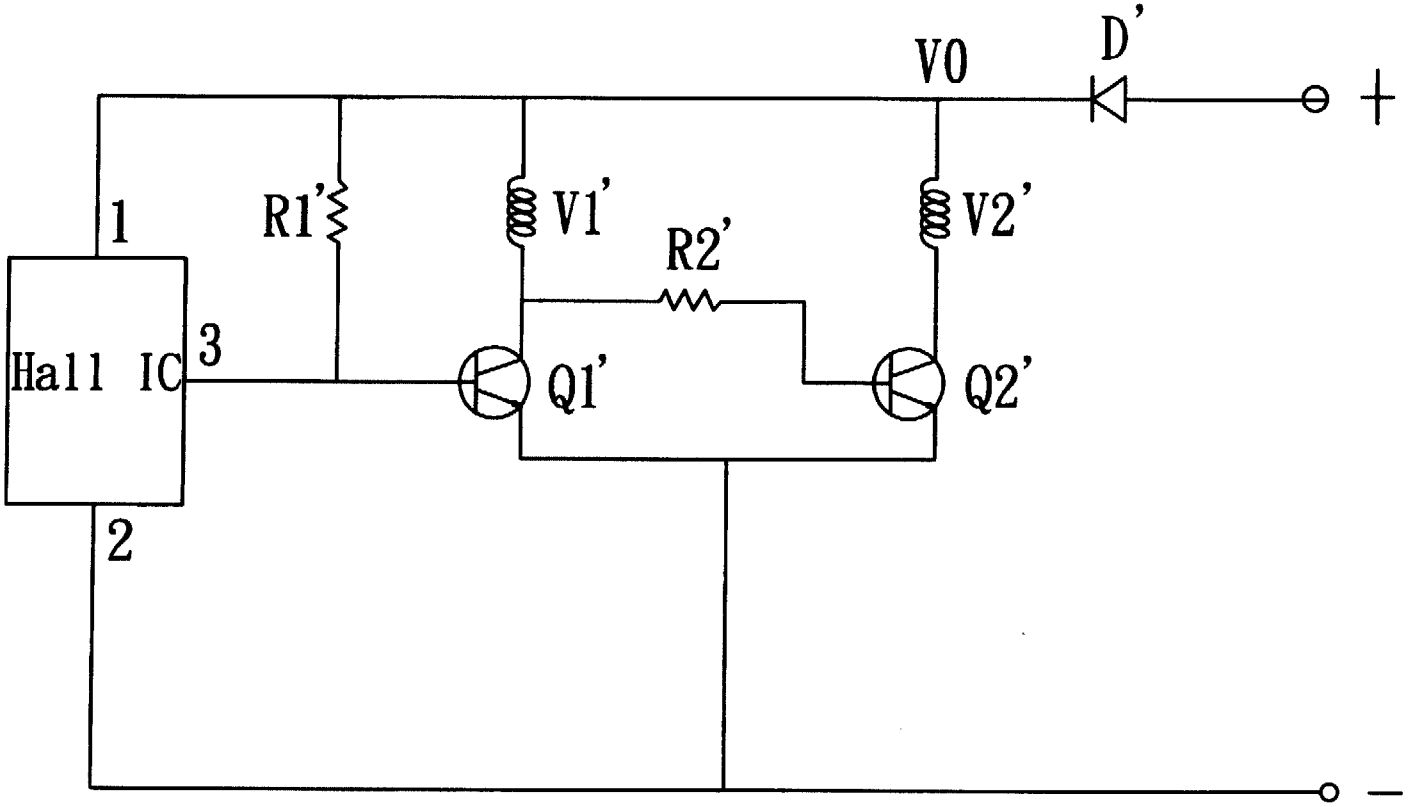
FIG. 1 (PRIOR ART)
FIG. 1 is a diagram of the conventional drive circuit.
Figure 2:
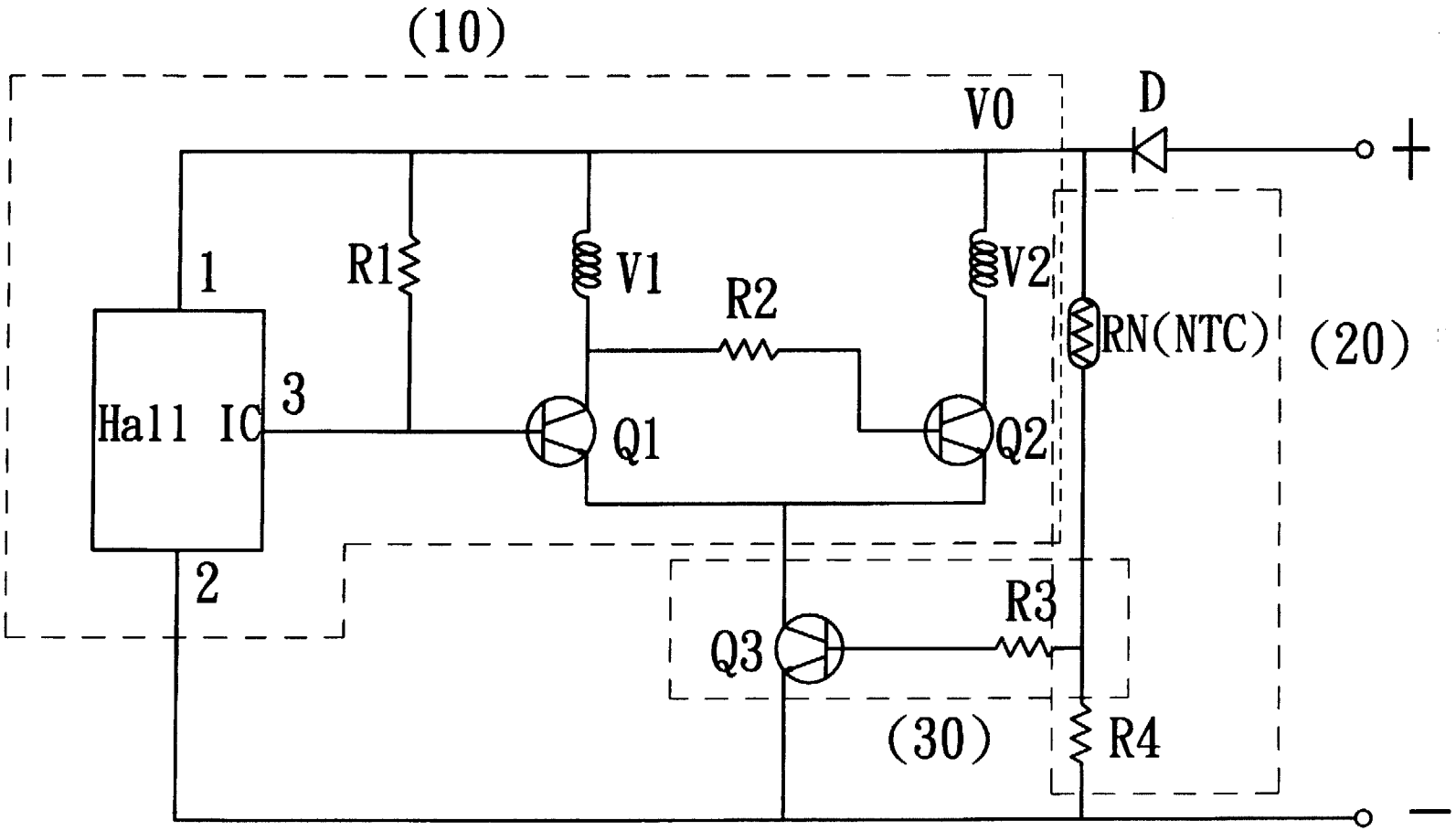
FIG. 2 is a diagram of a drive circuit for a speed automatically adjusted fan in a preferred embodiment of the invention.

Referring to FIG. 2 first, a preferred embodiment of the present invention is illustrated and it can be seen that the drive circuit of a speed automatically adjusted fan in accordance with is comprised of an actuating circuit (10), a temperature control circuit (20) and a current control circuit (30).

The actuating circuit (10) has a Hall IC at an output terminal thereof to connect with the base pole of a transistor (Q1). The collector of the transistor (Q1) is connected to a coil (V1) in a DC fan, and connected to the base pole of another transistor (Q2) through a resistor (R2) respectively. The collector of the transistor (Q2) is connected to another coil (V2) of the DC fan. Both of the emitter of the transistor (Q1) and the emitter of the transistor Q2) are connected to the current control circuit (30) such that both the transistors (Q1, Q2) can control coils (V1, V2). Furthermore, the Hall IC controls the transistor (Q1) and the transistor (Q2) in a state of connecting and in a state of disconnecting sequentially to alternately magnetize the coils (V1, V2) so as to rotate the fan.

The temperature control circuit (20) is composed of a heat sensitive resistor RN (NTC) and a resistor (R4). An end of the heat sensitive resistor RN (NTC) is connected to a power supply, and the other end of the heat sensitive resistor RN (NTC) is connected to the current control circuit (30) and grounded through a resistor (R4), respectively. The heat sensitive resistor RN (NTC) senses the temperature in the area of the main board in a computer and the resistance value of the resistor RN (NTC) varies with respect to a variation of the temperature such that the magnitude of the current passing through will be changed accordingly.

The current control circuit (30) is composed of a transistor (Q3) and a resistor (R3). The collector of the transistor (Q3) is connected to the emitters of the two transistors (Q1, Q2) respectively. Because the temperature control circuit (20) serves to sense the temperature in the computer, the higher the temperature is, the smaller the resistance of the heat sensitive resistor RN (NTC) is such that more current will flow through the temperature control circuit. The current control circuit (30) receives the current coming from the heat sensitive resistor RN (NTC) and feeds back the current to the two transistors (Q1, Q2) connecting with the coils (V1, V2). Thus, the speed of the fan can be controlled to have an adjustment based on a Variation of the temperature, that is, the higher the temperature is, the faster the speed of the fan turns.

It is noted that the above description of the preferred embodiment of the present invention merely is an explanatory example only. It is appreciated that the drive circuit of a speed automatically adjusted fan according to the present invention is not only practically useful but also novel. Therefore, the present invention fully satisfies the requirements of a patent.

Moreover, although the present invention has been described with reference to a preferred embodiment thereof, it is to be understood that modifications or variations may be easily made without departing from the spirit of this invention which is defined by the appended claims.

What is claimed is:

1. A drive circuit for a speed automatically adjusted fan, comprising:

two coils (V1, V2) in a DC fan, being connected to a power source;

an actuating circuit (10), providing a Hall integrated circuit, and a first and a second transistors (Q1, Q2) to connect with the coils (V1, V2) respectively;

a current control circuit (30), providing a third transistor (Q3) and a resistor (R3) to connect the first transistor (Q1) and the second transistor (Q2); and a temperature control circuit (20), providing a first end connecting with the power source too, and a second end being grounded;

characterized in that the temperature control circuit (20) has a heat sensitive resistor RN(NTC) near the first end thereof and a resistor (R4) near the second end thereof, and a base pole of the third transistor (Q3) in the current control circuit (30) connects with the temperature control circuit through the resister (R3) and a collector of the third transistor (Q3) connects with a respective emitter of the first and the second transistor (Q1, Q2);

whereby, the higher an ambient temperature surrounding the heat sensitive resistor RN(NTC) is, the smaller a resistance of the heat sensitive resistor RN(NTC) is such that more current may be flowed into the current control circuit and the speed of the fan becomes faster.

* * * * *

UNITED STATES PATENT AND TRADEMARK OFFICE

CERTIFICATE OF CORRECTION

PATENT NO. : 6,297,608 B1
DATED : October 2, 2001
INVENTOR(S) : Yu Liang Lin

It is certified that error appears in the above-identified patent and that said Letters Patent is hereby corrected as shown below:

Title page,
Item [73], Assignee, delete "Vitel" and insert -- Vital --.

This certificate supersedes Certificate of Correction issued March 19, 2002.

Signed and Sealed this

Fifteenth Day of October, 2002

*Attest:*

*Attesting Officer*

JAMES E. ROGAN
*Director of the United States Patent and Trademark Office*